US005611144A

United States Patent [19]

Gusky

[11] Patent Number: 5,611,144

[45] Date of Patent: Mar. 18, 1997

[54] METHOD OF MANUFACTURING UNIQUE JEWELRY AND ARTICLE FORMED THEREFROM

[75] Inventor: Michael Gusky, Fort Lauderdale, Fla.

[73] Assignee: Aurafin Corporation, Sunrise, Fla.

[21] Appl. No.: 657,758

[22] Filed: May 31, 1996

[51] Int. Cl.[6] ..... B21L 17/00

[52] U.S. Cl. ..... 29/896.411; 59/79.1; 59/30; 59/35.1

[58] Field of Search ..... 59/79.1, 79.2, 59/79.3, 83, 78, 80, 29, 30, 1, 35.1; 29/896.411

[56] References Cited

U.S. PATENT DOCUMENTS

| | | | |
|---|---|---|---|
| 223,803 | 1/1880 | Falize, Jr. . | |
| 263,691 | 9/1882 | Edge . | |
| 302,036 | 7/1884 | Rothschild . | |
| 758,330 | 4/1904 | Mulvaney . | |
| 1,784,582 | 12/1930 | Döppenschmitt . | |
| 1,784,786 | 12/1930 | Durand . | |
| 1,840,047 | 1/1932 | Mealy . | |
| 1,840,771 | 1/1932 | Duerr . | |
| 1,849,741 | 3/1932 | Döppenschmitt . | |
| 2,054,408 | 9/1936 | Casey . | |
| 2,064,322 | 12/1936 | Ruppert . | |
| 2,079,386 | 5/1937 | Schofer . | |
| 2,153,659 | 4/1939 | Bork . | |
| 2,180,980 | 11/1939 | Fassnacht et al. . | |
| 2,200,828 | 5/1940 | Augenstein . | |
| 2,252,305 | 8/1941 | Püschner et al. . | |
| 2,306,317 | 12/1942 | Morrow . | |
| 2,829,488 | 4/1958 | Valli . | |
| 2,852,923 | 9/1958 | Gamelsky | 29/896.411 |
| 2,893,201 | 7/1959 | Jaeger . | |
| 3,254,396 | 6/1966 | Mushey . | |
| 3,372,500 | 3/1968 | Claude . | |
| 3,590,759 | 7/1971 | Hendrie, Jr. . | |
| 3,613,195 | 10/1971 | Senior . | |
| 3,838,488 | 10/1974 | Tada et al. . | |
| 4,095,415 | 6/1978 | Bower | 59/79.2 |
| 4,266,400 | 5/1981 | Tabata . | |
| 5,205,039 | 4/1993 | Ternes . | |
| 5,441,686 | 8/1995 | Jackl et al. . | |
| 5,542,245 | 8/1996 | Lunardon | 59/35.1 |

FOREIGN PATENT DOCUMENTS

| | | |
|---|---|---|
| 233166 | 9/1944 | Germany . |

*Primary Examiner*—David Jones

*Attorney, Agent, or Firm*—Malin, Haley, DiMaggio & Crosby, P.A.

[57] ABSTRACT

A method of manufacturing jewelry and a chain article formed therefrom which provides an embossed, decorative pattern in either surface of an omega-style chain. A length of wire mesh or woven wire type of "fabric" of a width and length corresponding generally to the proportions of the jewelry chain to be created is provided whereon a series of hollow link sections are received such that the interior surfaces of the links surround the mesh. The links are arranged in end-to-end abutting relationship upon the mesh until the length of chain desired is reached. Upper and lower die members are brought into contact with the preformed chain and forced thereagainst with a magnitude of pressure and for a duration of time sufficient to deform the links and bring the inner surfaces thereof into at least partial engagement with the mesh. The contour of the operating surfaces of the upper and lower dies may be of any desired ornamentation, as the finished chain conforms thereto, and at least one of the working surfaces of the upper and/or lower dies is provided with an ornamenting pattern which forms a corresponding embossed expression in at least part of one surface of the chain.

1 Claim, 7 Drawing Sheets

METHOD OF MANUFACTURING UNIQUE JEWELRY AND ARTICLE FORMED THEREFROM

BACKGROUND OF THE INVENTION

1. Field of the Invention

This invention relates generally to the field of jewelry, and more particularly relates to a method for manufacturing an ornamental jewelry chain wherein the chain is flexible and also has an embossed, decorative pattern formed in at least one surface thereof.

2. Description of the Prior Art

The style of jewelry chain to which this invention pertains is commonly referred to as "omega." To manufacture an omega-style chain, a flexible substrate, such as a woven wire mesh sheet, is provided, over which is passed a plurality of independent links in end-to-end abutting relation. The thus preformed chain section is placed between the upper and lower dies of a press. The links are then generally uniformly pressed onto the substrate, causing the links to deflect and come into substantial contact with the substrate. The resulting cross sectional shape of the chain is dictated by the contour of the upper and lower dies of the press. The finished chain remains contiguous, but is flexible due to the fact that the links are independent of one another and are supported by the flexible mesh substrate. In this manner, very attractive jewelry items have been created which appear rigid, but are flexible and thus appealing to the wearer and resistant to permanent deformation and disfigurement.

What has heretofore not been proposed is to provide an embossed, decorative pattern in either surface of such omega-style chains.

It is, therefore, a principal object of this invention to provide ornamental, flexible jewelry chain which is both flexible and carries an embossed or impressed pattern thereon and which can be made into necklace, bracelet or any other chain-type jewelry.

It is also an object of this invention to provide a method of manufacturing the unique jewelry chain disclosed herein which accomplishes the aforedescribed objective without adding any additional steps to preexisting manufacturing methods.

It is a still further object of this invention to provide a novel jewelry chain which is flexible, yet carries a continuous or discontinuous pattern thereon.

SUMMARY OF THE INVENTION

The method of the present invention includes initially providing a length of wire mesh or woven wire type of "fabric" of a width and length corresponding generally to the proportions of the jewelry chain to be created. A series of hollow link sections are received upon the mesh such that the interior surfaces of the links surround the mesh. The links are arranged in end-to-end abutting relationship upon the mesh until the length of chain desired is reached. The thus preformed chain is placed between upper and lower die members of a press. The upper and lower die members are brought into contact with the preformed chain and forced thereagainst with a magnitude of pressure and for a duration of time sufficient to deform the links and bring the inner surfaces thereof into at least partial engagement with the mesh. The contour of the operating surfaces of the upper and lower dies may be of any desired ornamentation, as the finished chain conforms thereto. At least one of the working surfaces of the upper and/or lower dies is provided with an ornamenting pattern which forms a corresponding embossed expression in at least part of one surface of the chain.

In one embodiment of the invention to be hereinafter described in greater detail, the links are generally rectangularly shaped in cross section and are of a width which corresponds generally with the width of the mesh. It is important to note, however, that chain of varying width can be manufactured, one version of which includes the use of mesh and links having a gradually changing width. Naturally, the upper and lower dies utilized to create the finished chain are configured to match.

It is also possible by utilizing the instant invention to create chain having various embossed patterns within a single production run by providing upper and/or lower die working surfaces which are removable, in part or in whole, to interchange the pattern-forming sections thereof.

The pattern may be created in the working surface(s) of the die(s) by any known means, such as electric die making (EDM), laser etching, etc. It has been found that the height of the resulting embossed pattern in the finished chain is a function of the thickness of the walls of the link sections, the depth of the etched pattern in the working surface(s) of the die(s), the compression force imposed by the press during manufacture, and the height of the inner surface of the link versus the distance the link wall is compressed toward the mesh when compressed. Different results can be obtained by varying any of these parameters, any combination of which is contemplated to be within the scope of the invention. Other parameters which will occur to the skilled artisan are likewise contemplated to fall within the scope of my invention.

It can thus be readily seen that the method of manufacturing jewelry chain of the type described herein imparts a three-dimensional design or embossed pattern into a product at the same time as it is assembled, such that no additional working steps are required. A completed product, ready for traditional finishing procedures (e.g.: clasp installed, chain limbering, heat treating, and polishing), results.

The link segments may be in the form of box-like segments formed through a separate manufacturing process, or may be formed over the mesh from flat or staple-shaped links which are wrapped around the mesh in a pre-pressing step or during the actual creation of the chain with the embossed pattern thereon. In addition, it has been found to be desirable to first press the links into contact with the mesh, with perhaps a lighter pressing force than what is to be used in a final pressing step, so as to secure the links preliminarily to the mesh. This facilitates easier manipulation of the chain before final pressing/assembly, wherein the links can be fit accurately together and the chain can be cleaned prior to the final pressing step. In this way, a continuous, clear, embossed pattern can be accurately imparted to the chain, creating a highly attractive and desirable finished product.

Pressing may be carried out by stamping, rolling, or any other suitable means.

In accordance with these and other objects which will become apparent hereinafter, the instant invention will now be described with particular reference to the accompanying drawings.

DESCRIPTION OF THE PREFERRED EMBODIMENTS

Figure 1:
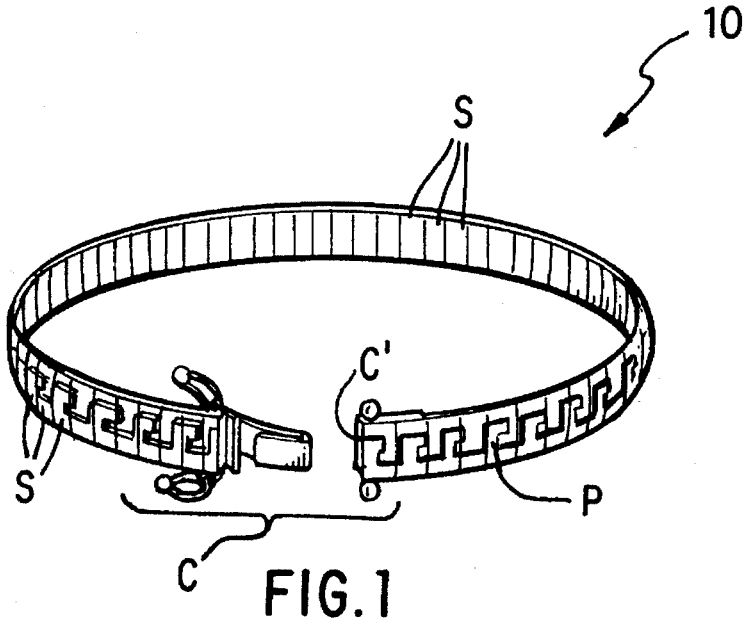
FIG. 1 is a perspective view of a finished jewelry article made in accordance with the instant invention.
Figure 2:
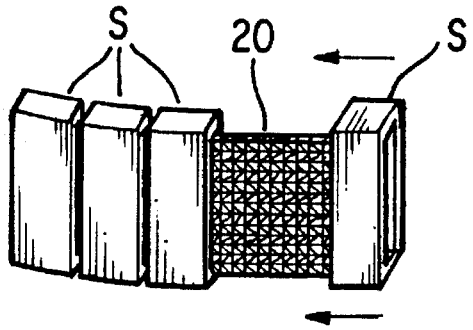
FIGS. 2 and 3 illustrate preformed links being slid over a mesh substrate during assembly of jewelry chain in accordance with this invention.
Figure 7:
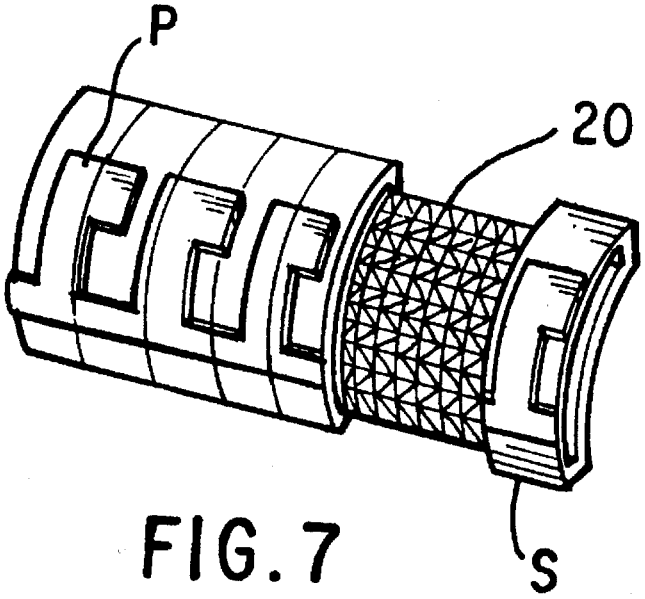
FIG. 7 is a partial exploded view of a portion of a finished jewelry chain manufactured in accordance with the instant invention.

Referring initially to FIG. 1, a flexible jewelry chain product 10 is shown in finished form. The product, which by way of example is in the form of a bracelet (but could alternatively be in the form of any chain-type structure such as the necklace shown in FIG. 7), is a flexible chain comprised of a series of link segments S arranged in end-to-end engagement in surrounding relationship about a substrate, which in the preferred embodiment is a flexible mesh 20 made up of gold wire mesh or woven or linked gold wire as best shown in FIG. 2. Additionally, the jewelry item 10 is provided with an embossed pattern P on its outer surface, which may or may not be continuous along the entire chain. A standard clasping arrangement C may be utilized, examples of which are shown in FIGS. 1 and 7.

Figure 3:
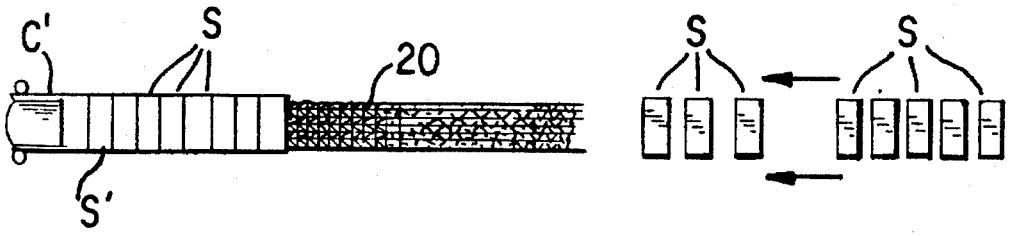

FIGS. 2 and 3 illustrate the step in the process of the instant invention wherein a series of independently formed and carried link segments S are placed upon mesh 20 such that the first such segment S' abuts female clasp element C'. It should be noted that the link segments S need not necessarily be rectangular in elevational projection, but may be of any desired shape to achieve the result of the instant invention. For example, but not by way of limitation, the necklace-type chain 100 of FIG. 6A utilizes link segments of varying heights.

Figure 4A:
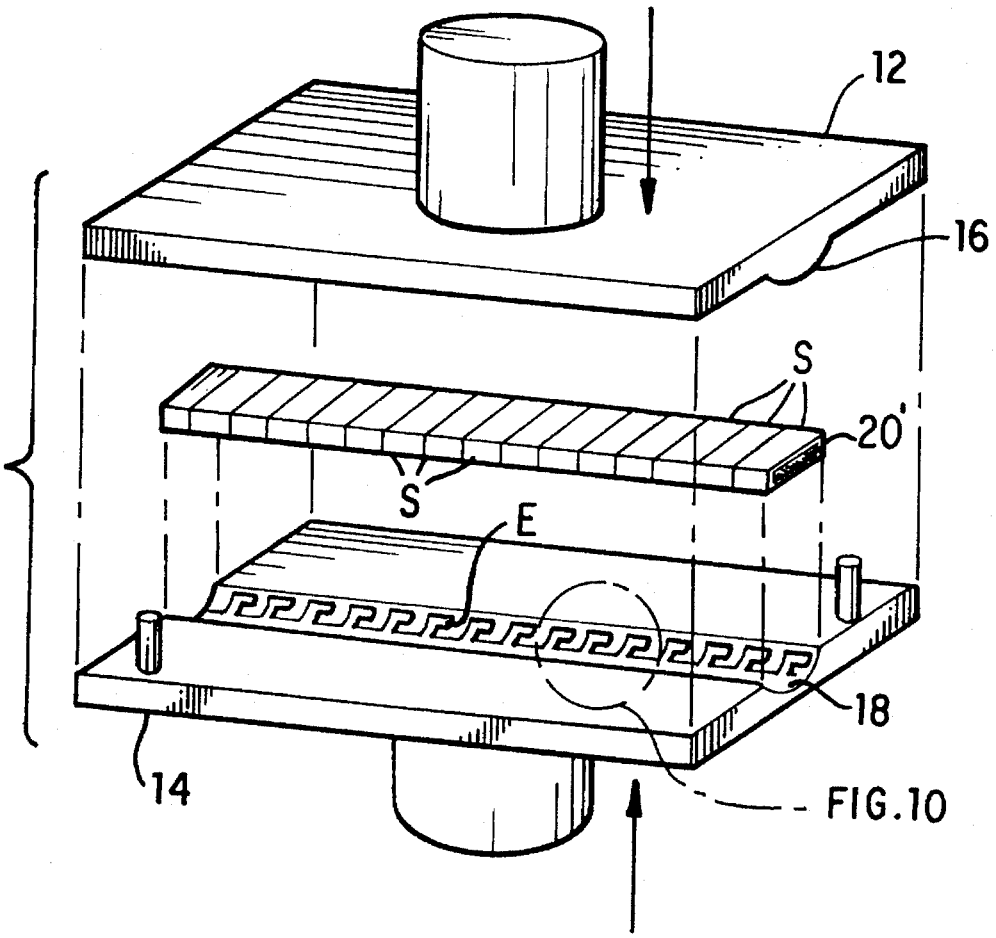
FIG. 4A is a perspective view of a preformed chain positioned between upper and lower die members of a press.

Once the link segments S are arranged upon mesh 20, resulting in a preformed chain 20' shown in FIGS. 3 and 4A, the preformed chain 20' is placed between upper die member 12 and lower die member 14. Upper die member 12 is provided with a convex pressing surface 16 which is utilized to create the inner or skin-facing surface of bracelet 10, while concave pressing surface 18 formed within lower die member 14 is adapted to form the outer-facing surface of bracelet 10.

Figure 4B:
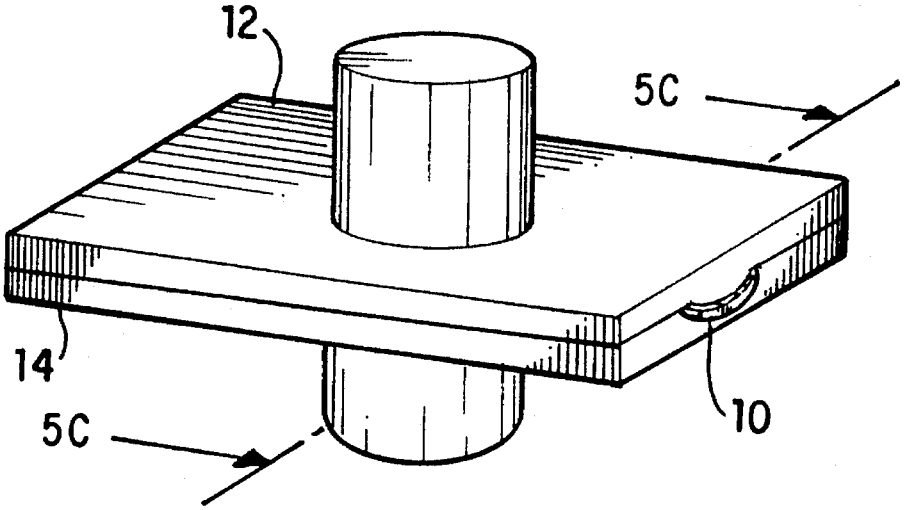
FIG. 4B shows the upper and lower die members of the press sandwiching the preformed chain to form it into a finished product.
Figure 4C:
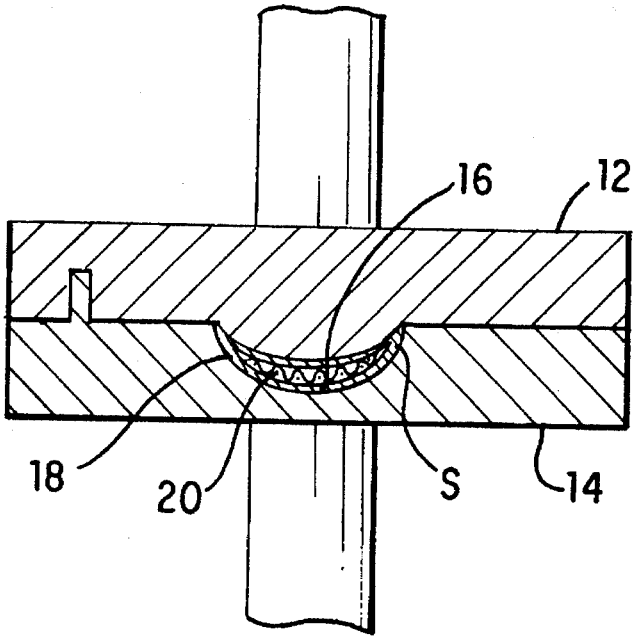
FIG. 4C is a cross sectional elevational view taken along lines 4C—4C of FIG. 4B.
Figure 10:
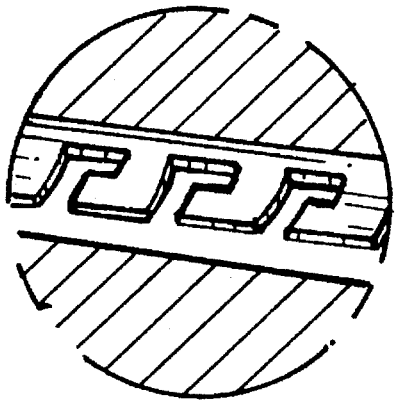
FIG. 10 is a closeup view of the pattern-forming recess of the lower die member shown in FIG. 4A.

Importantly, a pattern E is provided within lower die pressing surface 18 as shown in FIGS. 4A and 10. Pattern E is engraved into surface 18 and results in the raised or embossed pattern P in the final product-after upper and lower die members 12, 14, respectively, are brought into pressing engagement against preformed chain segment 20' by any conventional press (not shown), as best seen in FIGS. 4B and 4C.

Other ornamental chain segments can be formed utilizing this process, such as necklace 60 shown in FIGS. 5 and 6A–C. It is to be appreciated that the relative configuration and orientation of the link segments will be varied depending upon the particular type of product being produced. For example, the link segments S shown in FIGS. 1–4C result in a bracelet 10 which stands on its edge when arranged in its circular in-use configuration shown in FIG. 1. In order to result in a jewelry item such as necklace 60 shown in FIG. 5, which lays generally flat when placed on a horizontal surface or when worn, it is necessary that the link segments T be shaped and arranged about mesh 20 accordingly.

Figure 6C:
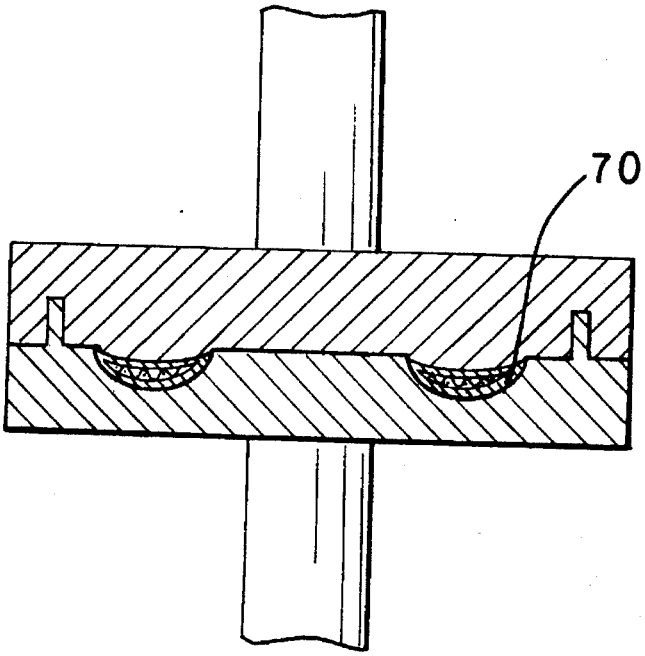
FIG. 6C is a cross sectional elevational view taken along lines 6C—6C of FIG. 6B.
Figure 5:
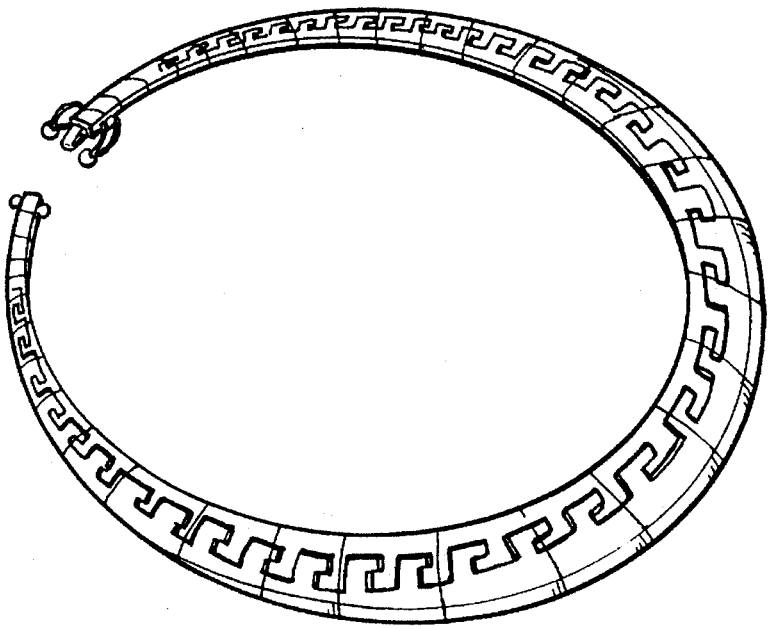
FIG. 5 is a perspective view of a necklace formed in accordance with the instant invention.
Figure 6A:
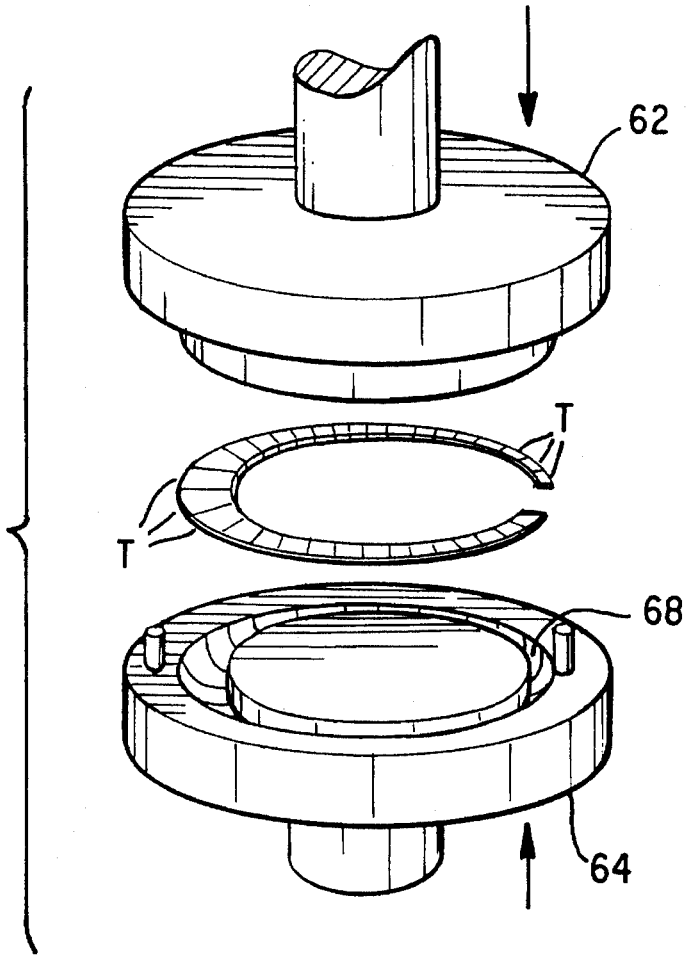
FIG. 6A is a perspective view of an alternative form of a preformed chain positioned between upper and lower die members of a press.
Figure 6B:
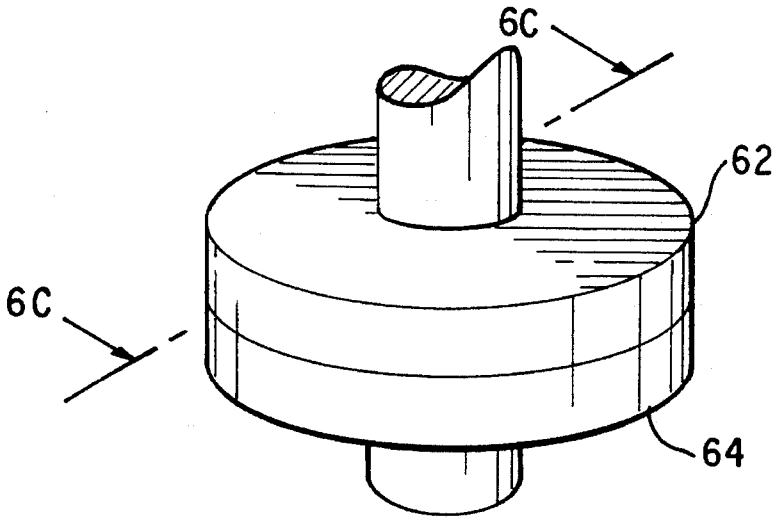
FIG. 6B shows the upper and lower die members of the press sandwiching the alternative form of the preformed chain to form it into a finished product.

Referring now to FIGS. 5 through 6C, the manufacture of a necklace in accordance with my invention is shown. As with the formation of a bracelet or similar chain, my necklace is formed by placing or passing appropriate link segments T about a gold wire mesh or woven or linked gold wire 70 and placing the preformed chain between upper and lower die members 62, 64, respectively. Lower die member 64 is provided with a pattern-forming channel 68 in the shape of one surface of the chain to be created. In keeping with the spirit of my invention, a decorative pattern F is engraved in channel 68 which results in a corresponding embossed decorative pattern Q associated with chain 70 after the pressing operations shown in FIGS. 6B and 6C are completed.

To assist in the manufacturing process, it may be desirable to string the link segments or otherwise place them about the mesh, cut the thus-preformed chain to the desired length, and temporarily solder the ends to retain the link segments about the mesh while the rest of the assembly process is carried out. Alternatively, or in addition thereto, a pre-stamping step may be included wherein, after the links are strung upon or placed about the mesh, the preformed chain is subjected to a first pressing, sufficient to engage the inner surfaces of the link segments against the mesh so as to generally position the links thereabout. This permits for the final adjustment of the spacing of the links, which preferably should be flush against each other in end-to-end engagement, and permits the assembler to clean the chain prior to final pressing. Cleaning of the preformed chain just prior to final pressing virtually eliminates the risk that the embossed pattern will be marred or otherwise affected during final pressing by dirt or other contaminants on the preformed chain. After the cleaning and alignment operation is carried out, final pressing can be performed. It should be noted that, in the preferred embodiment, the embossed pattern is not imparted to the chain during the pre-pressing operation, but is applied during final pressing. However, the embossed pattern could be applied in the pre-stamping stage and not in the final stage, or applied both during pre-stamping and then again or further in the final pressing stage.

Figure 9:
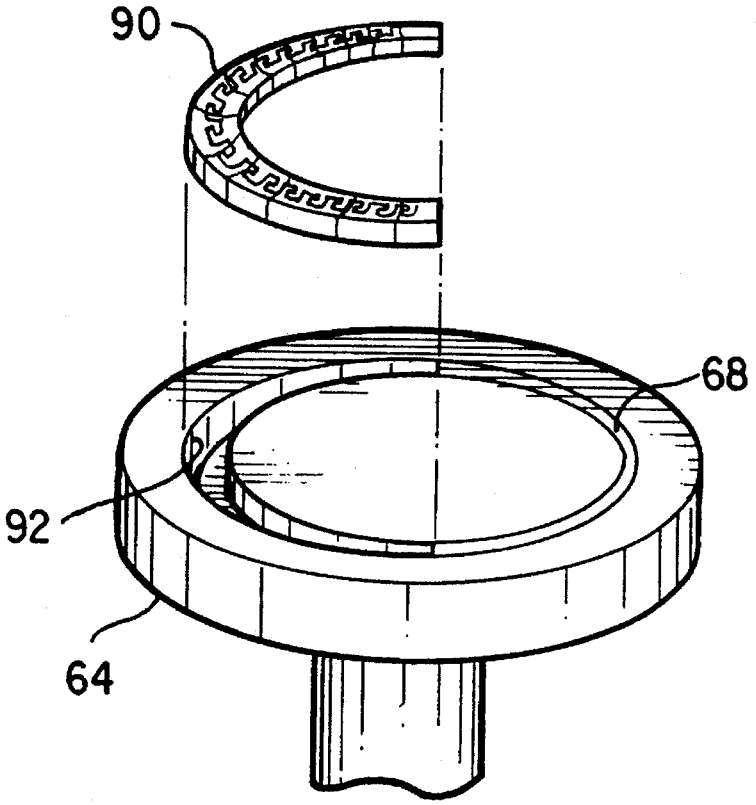
FIG. 9 is a still further alternative embodiment of a lower die member of a press for forming jewelry chain in accordance with this invention.
Figure 8:
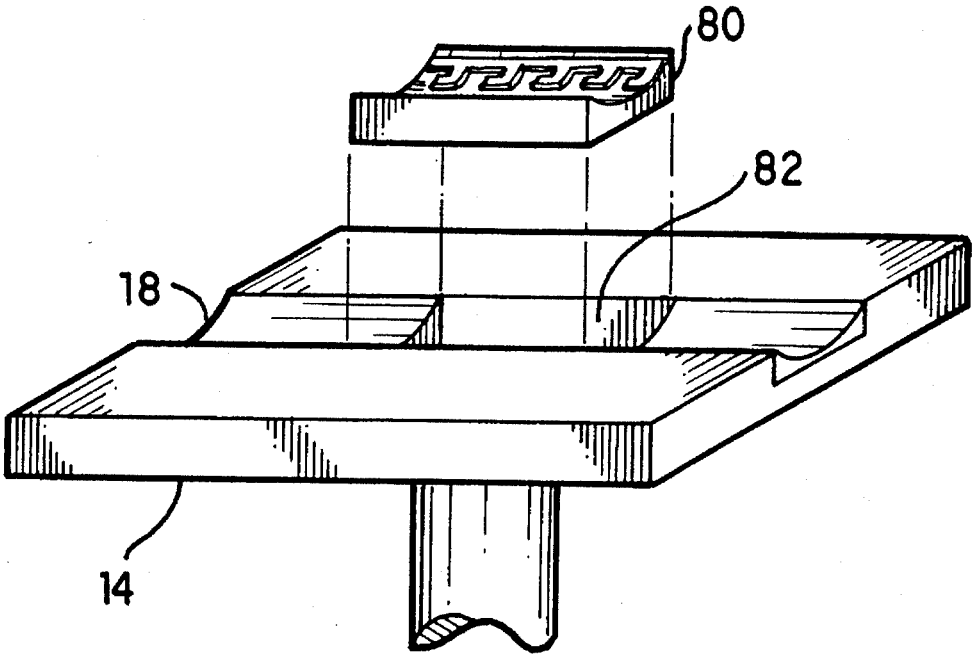
FIG. 8 shows an alternative arrangement of a lower die member of a press for forming jewelry chain in accordance with this invention.

Referring now to FIGS. 8 and 9, lower die members 14 and 64 may be provided with removable embossed pattern-forming plugs 80 and 90, respectively, such that one need not create entirely new die members to change the pattern embossed into decorative jewelry chain when changing from one pattern to another. It can readily be appreciated that substantial cost savings of manufacturing chain can be realized by the provision of removable plugs 80, 90, such that an entire set of such plugs with different patterns on each plug can be utilized. Plugs 80 and 90 fit into corresponding plug recesses 82, 92, respectively, in lower die members 14, 64. Lower die member 14 is utilized to make straight chain, such as for a bracelet, while lower die member 64 is used to manufacture curved chain, as in the case of a necklace. It is to be understood that the particular shape of the die or of the pattern-forming recesses 18, 68 shown in the drawings are by way of example only, and any desirable configuration and/or contour which may occur to a skilled artisan or to the lay person is contemplated. Likewise, the patterns E or F which are engraved into lower die members 14, 64, respectively, can take any form without limitation. Also, multiple plugs may be used simultaneously in a single die member or in both upper and lower die members as desired.

A force of 800 Bar (11,760 psi) has been utilized in manufacturing the necklace shown in FIG. 5, while a force of 400 Bar (5,880 psi) has been utilized in manufacturing the bracelet shown in FIG. 1. It is to be understood, however, that these values may be varied within ranges which would occur to one skilled in the art. The height of the embossed pattern P relative to the remainder of the outer surface 22 of chain 10 is primarily dependent upon the depth of the engraved pattern E in lower die member 14 and the distance which the link segments S are deflected during the pressing step shown in FIG. 4B from their original configuration shown in FIG. 2. The deflection distance is, in turn, dependent in part upon the force applied by the press, as well as the spacing of chain-forming members 16 and 18 throughout the process. The same applies to the manufacture of other chain, such as the necklace shown in FIG. 5 utilizing the structure and methods of use thereof shown in FIGS. 6 through 9.

Figure 11:
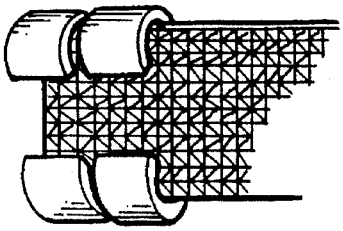
FIG. 11 is a back perspective view of a portion of a jewelry chain manufactured utilizing alternatively shaped link segments.

As shown in FIG. 11, the link segments 100 may be in the form of incomplete boxes, i.e., with only partial backs, which are pressed upon the mesh 120 in a staple-like fashion. Utilizing link segments of this type permits for the use of less precious metal and, hence, a lower weight and cost of the resultant article. The preformed chain utilizing such staple-like links 100 can be pre-aligned, cleaned, and stamped such that an embossed pattern (not shown) is imparted in the finished product similarly to the process and resultant articles shown in the previous drawing Figures. Utilizing links of this type results in the mesh 120 being exposed on the interior, i.e., skin-facing side.

Figure 12:
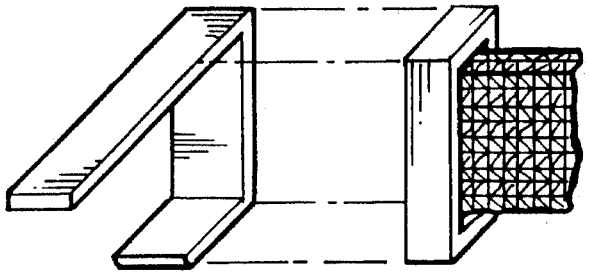
FIG. 12 is a perspective view illustrating the process of assembling link segments simultaneously with the formation of a preformed chain.

It is also possible to vary my invention by utilizing link segments 140, shown in FIG. 12, which are wrapped around the mesh either by hand or a machine during the pre-forming stage instead of utilizing finished links S, which are more costly to pre-manufacture. In this alternative embodiment, the flat or C-shaped preformed link segments 140 are wrapped about the mesh so as to be generally snug thereto. Thereafter, the intermediate fitting and cleaning can be carried out, after which the final stamping, including the embossment of the article, is performed.

After the embossing is completed, the chain may need to be limbered, such as by heat treating and/or mechanical manipulation.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A method of manufacturing decorative chain, comprising the steps of:

providing a length of woven wire fabric having a length and width corresponding to the chain to be created;

passing a series of independent hollow link segments over said fabric, said link segments being arranged in end-to-end abutting relationship to form a preformed flexible chain;

placing the preformed chain between die members of a press, wherein at least an upper working surface of one of said die members is provided with indentation means for creating an embossed pattern on at least one surface of said link segments;

bringing working surfaces of said die members into contact with said link segments and subjecting the preformed chain to a pressing force for a predetermined duration to cause the link segments to deform into a configuration corresponding to the contour of said working surfaces of said die members, including causing at least one surface of at least some of said link segments to have an embossed pattern disposed therein.

* * * * *